US006844867B2

(12) United States Patent
Yamada

(10) Patent No.: US 6,844,867 B2
(45) Date of Patent: Jan. 18, 2005

(54) LCD DRIVE APPARATUS

(75) Inventor: Kouji Yamada, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 355 days.

(21) Appl. No.: 10/130,766

(22) PCT Filed: Sep. 25, 2001

(86) PCT No.: PCT/JP01/08318

§ 371 (c)(1),
(2), (4) Date: May 23, 2002

(87) PCT Pub. No.: WO02/27703

PCT Pub. Date: Apr. 4, 2002

(65) Prior Publication Data

US 2002/0190938 A1 Dec. 19, 2002

(30) Foreign Application Priority Data

Sep. 26, 2000 (JP) ..... 2000-292139

(51) Int. Cl.[7] ..... G09G 3/36
(52) U.S. Cl. ..... 345/99; 345/87; 345/211
(58) Field of Search ..... 345/87, 89, 94, 345/98, 99, 100, 208, 211, 212, 213; 327/535, 536; 363/59, 60

(56) References Cited

U.S. PATENT DOCUMENTS 5,859,632 A * 1/1999 Ito ..... 345/211
5,867,138 A * 2/1999 Moon ..... 345/92
6,275,208 B1 * 8/2001 Park ..... 345/94
6,317,120 B1 * 11/2001 Eu ..... 345/211
6,670,935 B2 * 12/2003 Yeon et al. ..... 345/89

FOREIGN PATENT DOCUMENTS

| | | |
|---|---|---|
| JP | 02-102522 | 8/1990 |
| JP | 11-167366 | 6/1999 |
| JP | 11-219147 | 8/1999 |

OTHER PUBLICATIONS

International Patent Search dated Dec. 18, 2001.

* cited by examiner

*Primary Examiner*—Kent Chang
(74) *Attorney, Agent, or Firm*—Morgan, Lewis & Bockius LLP

(57) ABSTRACT

A display voltage generating circuit (2-1) for generating display voltages needed to drive an LCD has switches (SW1-1 to SW1-5), of which each has one end connected to one of capacitors (C1 to C5) for smoothing display voltages (V1 to V5) and has the other end connected through one of resistors (R11 to R15) to a supplied voltage ($V_{CC}$). By an output from a timer (T-1), the switches are kept on for a predetermined period after electric power starts being supplied, so that the capacitors are charged with the supply voltage.

9 Claims, 7 Drawing Sheets

300

LCD DRIVE APPARATUS

TECHNICAL FIELD

The present invention relates to an LCD driver device incorporating a display voltage generating circuit for generating a display bias voltage (hereinafter referred to also as a "display voltage") needed to effect display on an LCD (liquid crystal display).

BACKGROUND ART

As shown in a typical block diagram in FIG. 6, an LCD driver device 100 is composed of a voltage step-up circuit 1, a display voltage generating circuit 2, a panel driver 3, and a control circuit 4 built around a CPU or the like. The voltage step-up circuit 1 steps up a voltage $V_{IN}$ supplied from a battery 200 to $V_{CC}$ and outputs the stepped-up voltage. From the voltage $V_{CC}$ output from the voltage step-up circuit 1, the display voltage generating circuit 2 produces, for example, five display voltages V1, V2, V3, V4, and V5.

Using the plurality of display voltages V1, V2, V3, V4, and V5 output from the display voltage generating circuit 2, the panel driver 3 drives a plurality of common lines $COM_1$, $COM_2$, . . . , $COM_m$ provided in an LCD 300. Moreover, according to display data D fed from the control circuit 4 or from outside, the panel driver 3 drives a plurality of segment lines $SEG_1$, $SEG_2$, . . . , $SEG_n$ provided in the LCD 300.

As shown in FIG. 7, the LCD 300 has a plurality of common lines $COM_1$, $COM_2$, . . . , $COM_m$ and a plurality of segment lines $SEG_1$, $SEG_2$, . . . , $SEG_n$ arranged respectively at predetermined intervals to form a matrix in X and Y directions. At each intersection between the common lines $COM_x$ (X=1, 2, . . . , m) and the segment lines $SEG_Y$ (Y=1, 2, . . . , n) is arranged a pixel P(x, y) having a liquid crystal layer, at one end of which is provided an electrode connected to the common line $COM_x$ and at the other end of which is provided an electrode connected to the segment line $SEG_Y$. Thus, depending on whether the voltage difference between the voltage applied to the electrode connected to the common line $COM_x$ and the voltage applied to the electrode connected to the segment line $SEG_Y$ is greater than a threshold value or not, the pixel P(x, y) is turned either on or off.

According to commands and display data fed in by way of external signal lines S, the control circuit 4 controls the other circuits provided in the LCD driver device 100, and effects display. Specifically, when a command is fed in by way of the signal lines S to instruct the LCD 300 to start display, the control circuit 4 makes the voltage step-up circuit 1, the display voltage generating circuit 2, and the panel driver 3 start operating. On the other hand, when a command is fed in by way of the signal lines S to instruct the LCD 300 to stop display, the control circuit 4 makes the voltage step-up circuit 1, the display voltage generating circuit 2, and the panel driver 3 stop operating. Through this control, the voltage step-up circuit 1, the display voltage generating circuit 2, and the panel driver 3 are operated only when display on the LCD 300 is effected. This contributes to low electric power consumption. The control circuit 4 is kept all the time fed with, as the supply voltage from which it operates, the voltage $V_{IN}$ output from the battery.

Here, immediately after the start of operation, it takes time for the voltage step-up circuit to produce the stepped-up voltage, and it also takes time to charge the capacitors that are connected individually to the plurality of voltage lines of the display voltage generating circuit to smooth the display voltages and the parasitic capacitance present in each pixel. Therefore, the display voltages increase with finite gradients. Thus, in conventional LCD driver devices, it takes as long as 300 to 400 [mS] after the display voltage generating circuit starts operating until the display voltages reach the prescribed levels. Nevertheless, the panel driver starts operating the LCD at almost the same time that the display voltage generating circuit starts operating. Inconveniently, this results in disturbance of the displayed image immediately after display is started on the LCD.

The reason is that starting the driving of the LCD before the display voltages reach the prescribed levels hinders the voltage difference applied to each pixel of the LCD from settling at the prescribed value. As a result, pixels that should be turned on are left off, and pixels that should be kept off are turned on. This disturbance continues for 300 to 400 [mS], which is a period long enough to permit the human eye to perceive it. This period can be shortened by driving the display voltages with higher capacity, but this leads to increased current consumption.

DISCLOSURE OF THE INVENTION

An object of the present invention is to provide an LCD driver device that operates with reduced disturbance of the displayed image immediately after display is started on an LCD and that achieves this without unduly increasing current consumption.

To achieve the above object, according to the present invention, an LCD driver device provided with a display voltage generating circuit for generating a display voltage as a bias voltage needed to effect display on an LCD, a capacitive element for smoothing the display voltage, and a panel driver for driving the LCD by using the display voltage is further provided with a charge circuit for charging the capacitive element with a supply voltage, a charge control switch circuit for switching the charge circuit between operating and non-operating states, and a charge control circuit for controlling the charge control switch circuit in such a way that the charge circuit is kept in the operating state for a predetermined period after the display voltage generating circuit starts operating.

In this circuit configuration, when no display is effected, the operation of the individual circuits is stopped to keep current consumption extremely low. When display is effected, immediately after the start of operation, the capacitive element for smoothing the display voltage is charged also by the supply voltage. This helps shorten the period required for the display voltage to reach the prescribed level after the display voltage generating circuit starts operating.

In this circuit configuration, the display voltage may be prevented from being supplied to the panel driver, or the panel driver may be prevented from operating, at least for the period required after the display voltage generating circuit starts operating until the display voltage reaches the prescribed voltage. This permits the display voltage to reach the prescribed level in a relatively short period after the display voltage generating circuit starts operating, and makes it possible to start driving the LCD once the display voltage reaches the prescribed level.

The period for which the charge circuit is kept operating may be set to be equal to the period required for the display voltage to reach the prescribed level with the charge circuit operating. This helps minimize the required period without increasing ineffective electric power consumption due to current that flows through the resistors after the display voltage generating circuit starts operating and even after all the display voltages have reached the prescribed voltages.

BEST MODE FOR CARRYING OUT THE INVENTION

Figure 1:
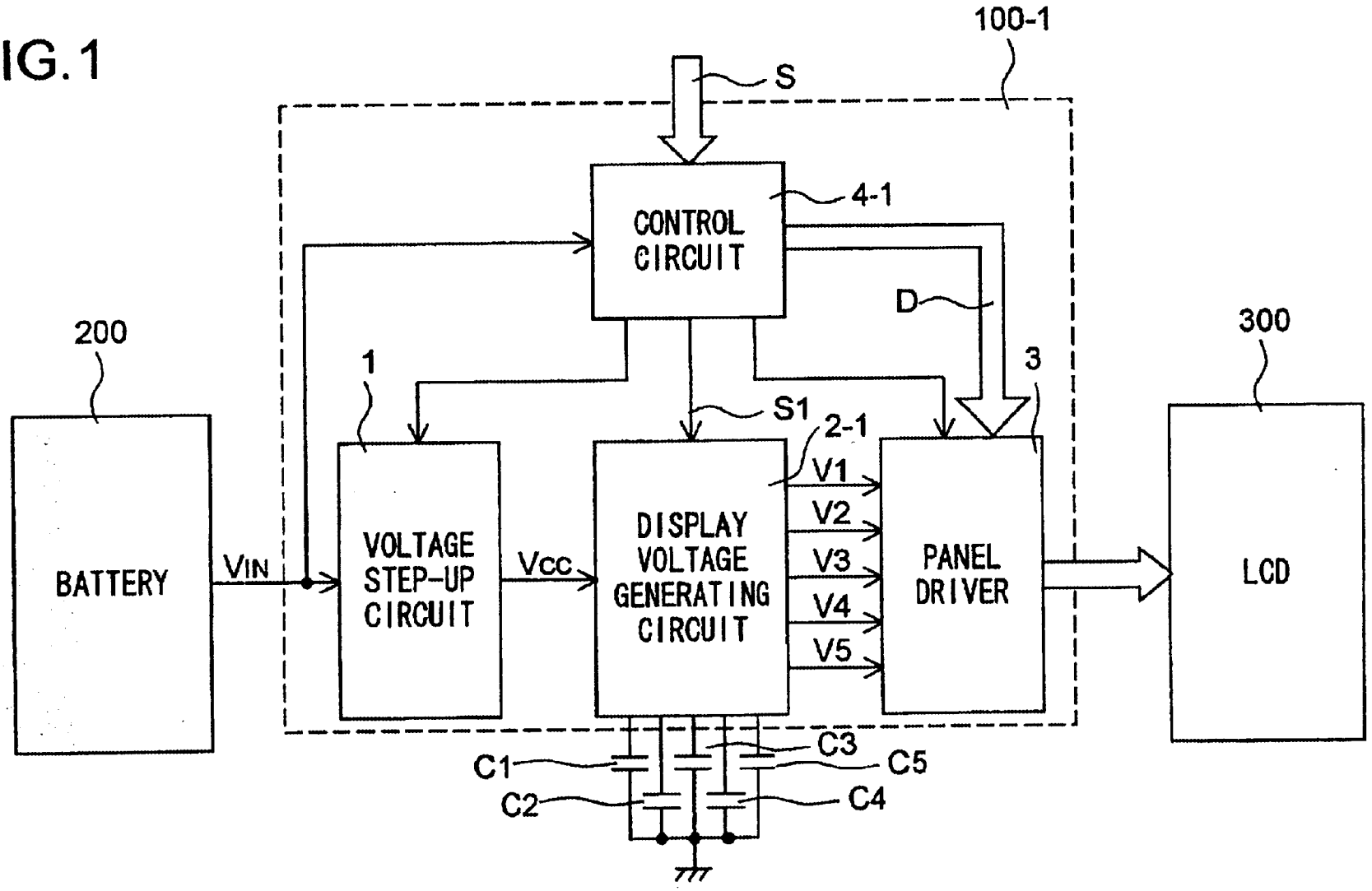
FIG. 1 is a block diagram of the LCD driver device of a first embodiment of the invention.
Figure 6:
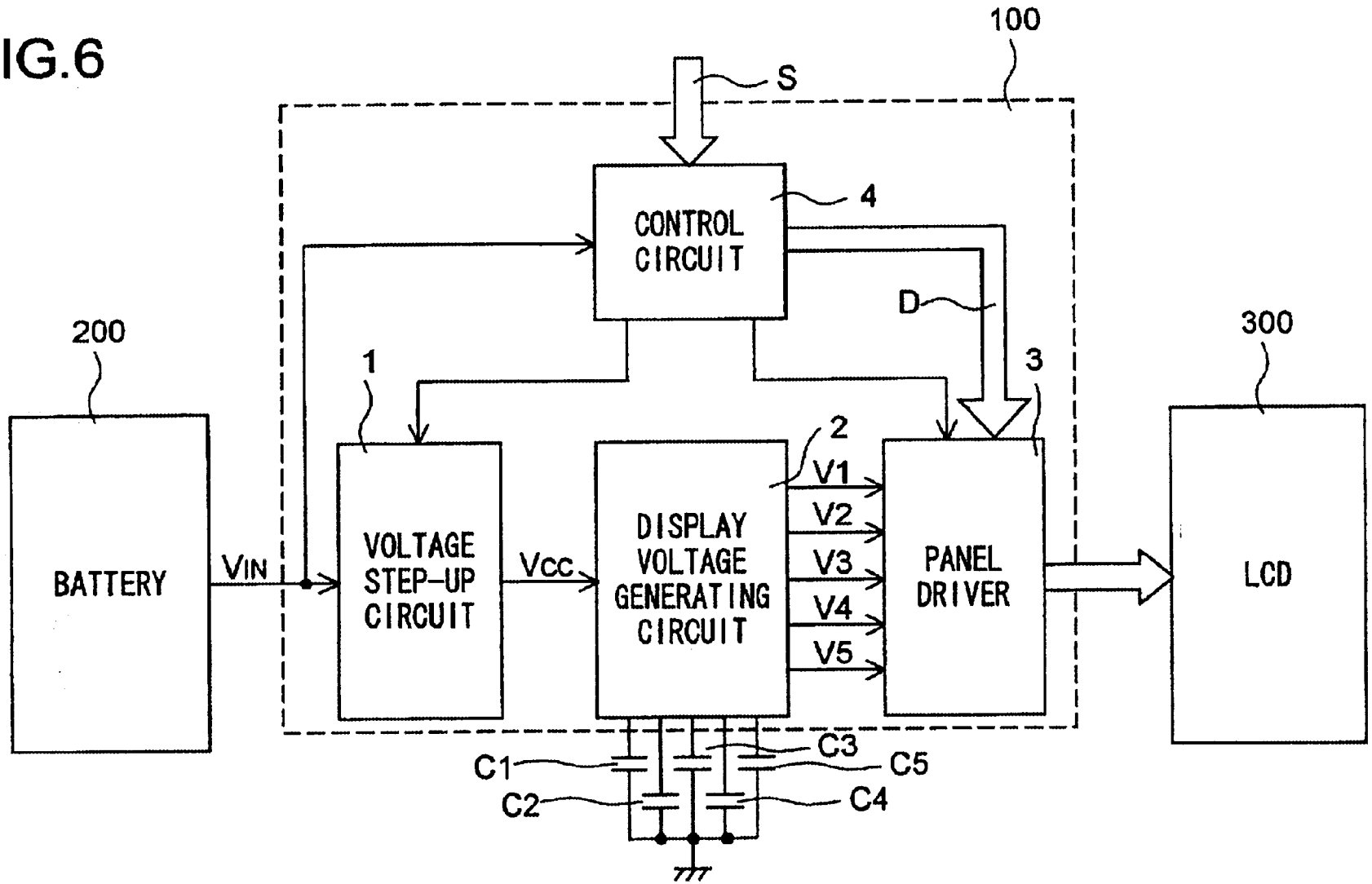
FIG. 6 is a block diagram of a conventional LCD driver device.
Figure 7:
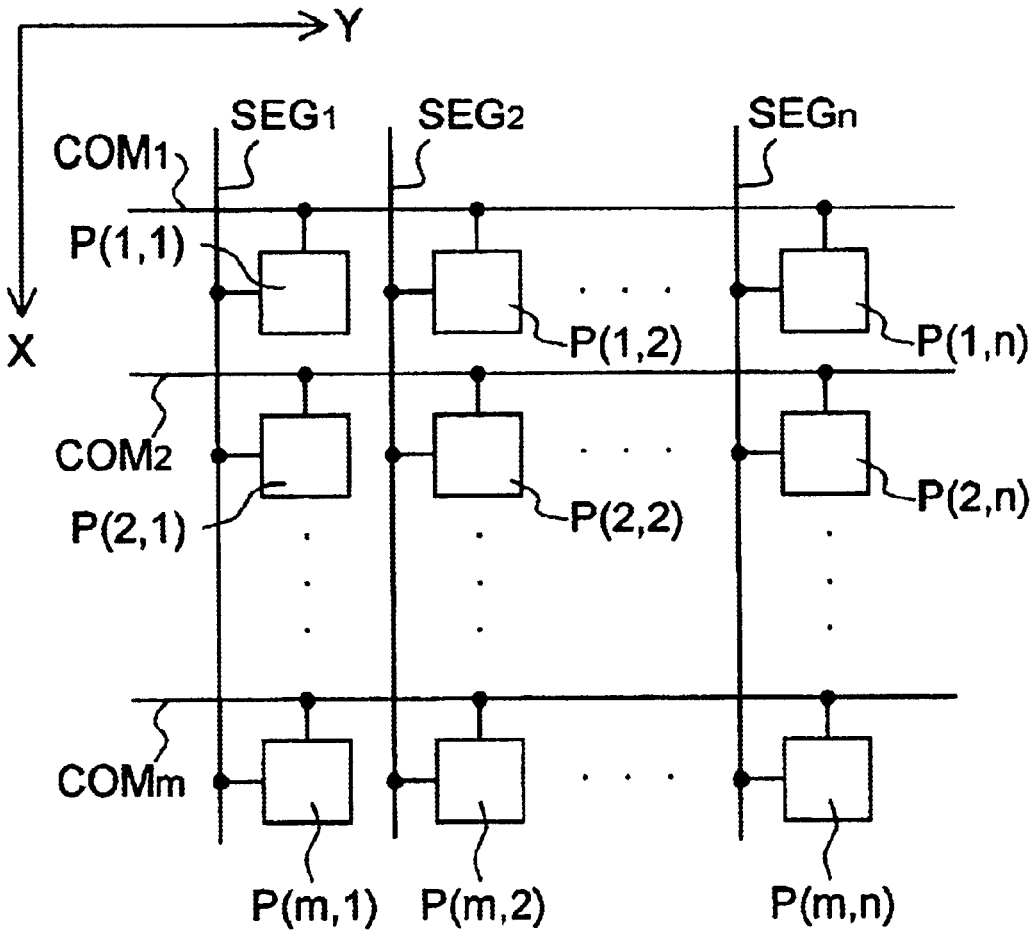
FIG. 7 is a diagram showing the structure of an LCD.

Hereinafter, embodiments of the present invention will be described with reference to the drawings. FIG. 1 shows a block diagram of the LCD driver device of a first embodiment of the invention. Here, such blocks and elements as are found also in the conventional LCD driver deice shown in FIG. 6 are identified with the same reference numerals and symbols, and their explanations will be omitted. The LCD driver device 100-1 of the first embodiment is composed of a voltage step-up circuit 1, a display voltage generating circuit 2-1, a panel driver 3, and a control circuit 4-1, and these are formed on a common semiconductor substrate to form a single-chip IC. From a voltage $V_{CC}$ output from the voltage step-up circuit 1, the display voltage generating circuit 2-1 produces, for example, five display voltages V1, V2, V3, V4, and V5.

Figure 2:
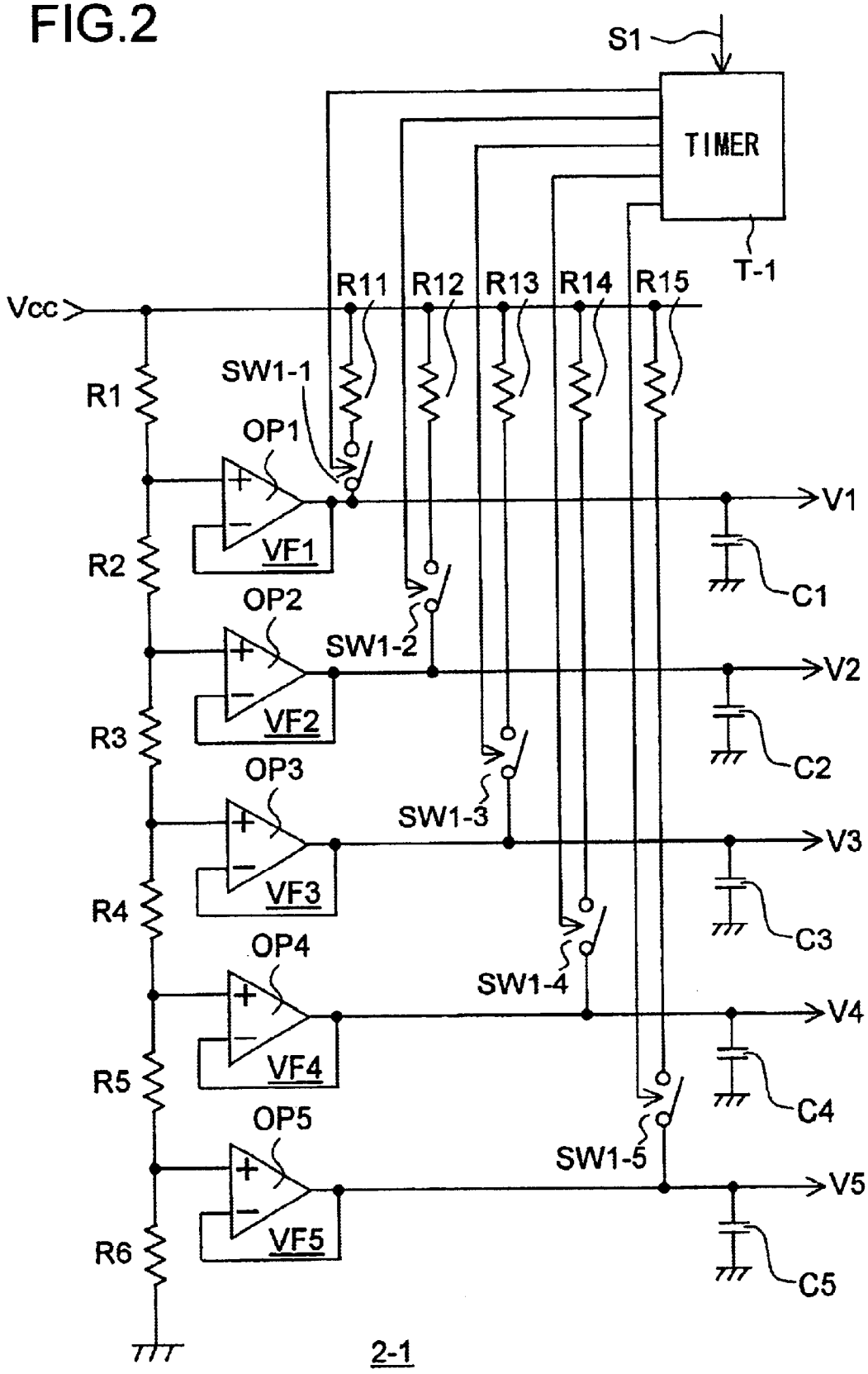
FIG. 2 is a diagram showing the configuration of the display voltage generating circuit provided in the LCD driver device of the first embodiment of the invention.

FIG. 2 shows the circuit configuration of the display voltage generating circuit 2-1. Between the supply voltage (the output voltage of the voltage step-up circuit 1) $V_{CC}$ and ground GND, resistors R1, R2, R3, R4, and R5 are connected in series in this order from the supply voltage $V_{CC}$ side.

The voltage at the node between the resistors R1 and R2, the voltage at the node between the resistors R2 and R3, the voltage at the node between the resistors R3 and R4, the voltage at the node between the resistors R4 and R5, and the voltage at the node between the resistors R5 and R6 are output as display voltages V1, V2, V3, V4, and V5 respectively through voltage follower circuits VF1, VF2, VF3, VF4, and VF5 formed by operational amplifiers OP1, OP2, OP3, OP4, and OP5 respectively. The display voltages V1, V2, V3, V4, and V5 are output after being smoothed by externally connected capacitors C1, C2, C3, C4, and C5 connected to the output side of the voltage follower circuits VF1, VF2, VF3, VF4, and VF5 respectively. Thus, the display voltages V1, V2, V3, V4, and V5 can safely be regarded as direct-current voltages.

A first group of switches SW1-1, SW1-2, SW1-3, SW1-4, and SW1-5 are connected, at one end, through resistors R11, R12, R13, R14, and R15 respectively to the supply voltage $V_{CC}$. The first group of switches SW1-1, SW1-2, SW1-3, SW1-4, and SW1-5 are connected, at the other end, to the node between the output side of the voltage follower FV1 and the capacitor C1, the node between the output side of the voltage follower FV2 and the capacitor C2, the node between the output side of the voltage follower FV3 and the capacitor C3, the node between the output side of the voltage follower FV4 and the capacitor C4, and the node between the output side of the voltage follower FV5 and the capacitor C5 respectively.

A timer T-1, on receiving a command requesting it to start counting in the form of a signal S1 from the control circuit 4-1, turns the first group of switches SW1-1, SW1-2, SW1-3, SW1-4, and SW1-5 on, and simultaneously starts counting. Thereafter, when the count value becomes equal to a value corresponding to a predetermined period (specifically, the period assumed to be required for the display voltage V5 to reach the prescribed level), the timer T-1 turns the first-group switch SW1-5 off. Then, when the count value becomes equal to the value corresponding to a predetermined period (specifically, the period assumed to be required for the display voltage V4 to reach the prescribed level); the timer T-1 turns the first-group switch SW1-4 off. Then, when the count value becomes equal to the value corresponding to a predetermined period (specifically, the period assumed to be required for the display voltage V3 to reach the prescribed level), the timer T-1 turns the first-group switch SW1-3 off. Then, when the count value becomes equal to the value corresponding to a predetermined period (specifically, the period assumed to be required for the display voltage V2 to reach the prescribed level), the timer T-1 turns the first-group switch SW1-2 off. Then, when the count value becomes equal to the value corresponding to a predetermined period (specifically, the period assumed to be required for the display voltage V1 to reach the prescribed level), the timer T-1 turns the first-group switch SW1-1 off.

The control circuit 4-1, when a command fed thereto requests starting of display on an LCD 300, controls the voltage step-up circuit 1, the display voltage generating circuit 2, and the panel driver 3 to start their operation, and feeds the signal S1 to the timer T-1 to instruct it to start counting.

In this configuration, immediately after the display voltage generating circuit 2 starts operating, the capacitors C1, C2, C3, C4, and C5 for smoothing the display voltages V1, V2, V3, V4, and V5 receive current also from the supply voltage $V_{CC}$ through the resistors R11, R12, R13, R14, and R15, and are thus charged more quickly than in the conventional configuration. As a result, whereas in the conventional configuration the display voltages V1, V2, V3, V4, and V5 each have a waveform as indicated by a broken line B in FIG. 3(*a*) in their rising period, in this embodiment they each have a waveform as indicated by a solid line A in FIG. 3(*a*). That is, the period required for each of the display voltages V1, V2, V3, V4, and V5 to reach the prescribed level is shortened to about 180 [mS]. Thus, even when the LCD 300 starts being driven at almost the same time (i.e. at $t_o$ in FIG. 3) that the display voltage generating circuit 2 starts operating, the driving voltages output from the panel driver 3 remain unstable only for a shorter period. This helps reduce disturbance of the displayed image that occurs immediately after display is started on the LCD 300.

Moreover, in the first embodiment, each capacitor is charged with the supply voltage $V_{CC}$ for the period that is assumed to be required for the corresponding display voltage to reach the prescribed level after the display voltage generating circuit 2-1 starts operating. This makes it possible to minimize the required period without increasing ineffective electric power consumption due to current that flows through the capacitors after the display voltages V1, V2, V3, V4, and V5 have reached the prescribed levels.

Figure 3:
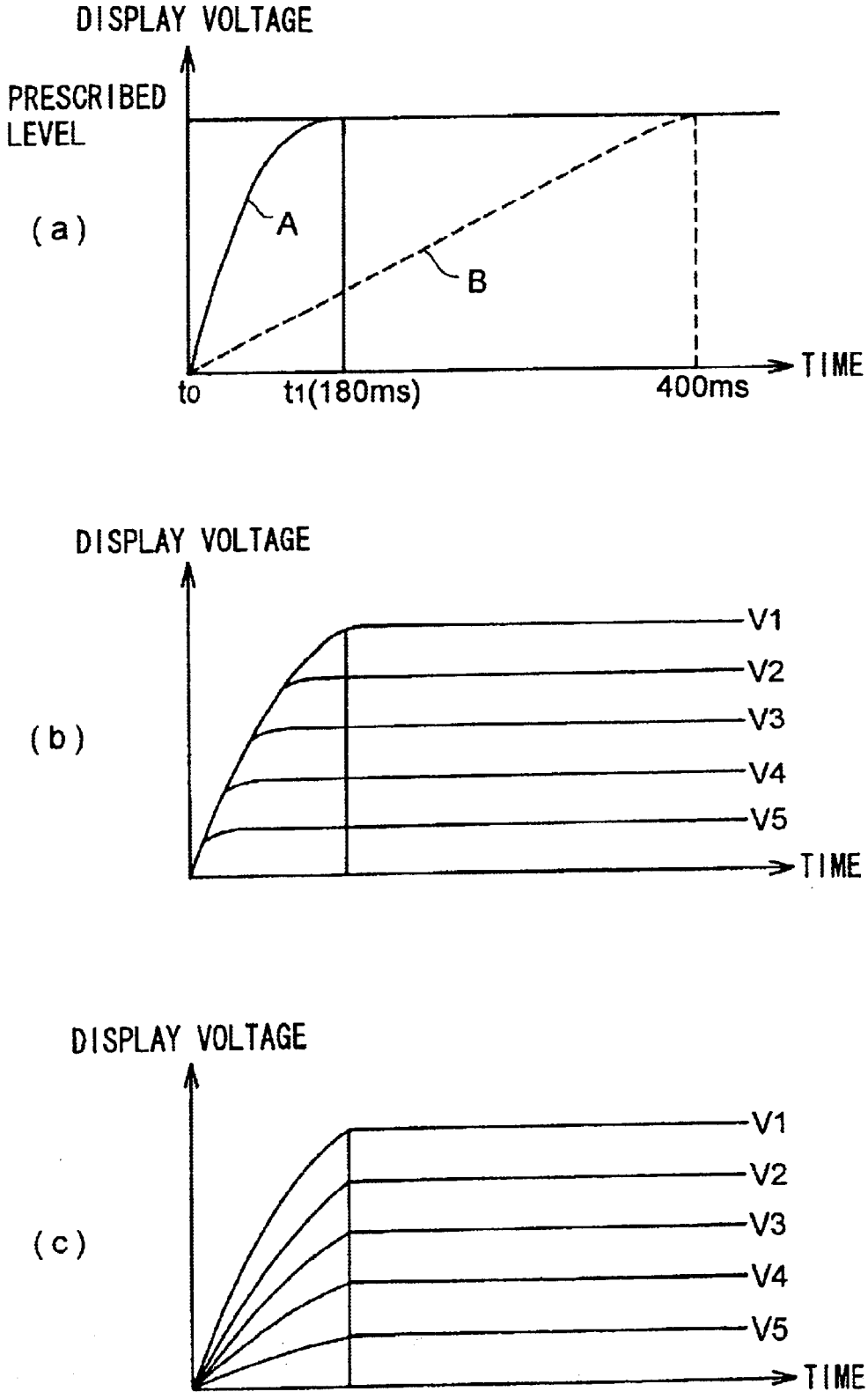
FIG. 3 is a diagram showing the waveforms of the display voltages in their rising period.

FIG. 3(*b*) shows how the individual output voltages rise to the prescribed voltages V1, V2, V3, V4, and V5 and behave thereafter when the resistors R11 to R15 are given the same resistance. In this case, each output voltage takes a different length of time to reach the prescribed level. Accordingly, the switch corresponding to each output voltage is turned off with different timing.

If all of the first group of switches are turned off simultaneously after all of the display voltages have reached the prescribed levels, instead of their being turned off one by one as the corresponding display voltages reach the prescribed levels one after another, ineffective electric power consumption arises in one or more of the resistors R11, R12, R13, R14, and R15 at a time.

This can be avoided by giving the resistors R11, R12, R13, R14, and R15 appropriate resistances so that resistors with higher resistances are connected to outputs with lower voltages. Then, as shown in FIG. 3(*c*), the display voltages V1, V2, V3, V4, and V5 take substantially the same length of time to reach the prescribed levels. This permits all of the first group of switches to be turned off with the same timing, and thus helps simplify the configuration of the timer T-1.

Moreover, by giving the resistors R11, R12, R13, R14, and R15 appropriate resistances, it is possible to make the display voltages V1, V2, V3, V4, and V5 reach the prescribed levels in a period as short as several tens to 200 [mS]. With the duration of disturbance of the displayed image so short, and in addition thanks to slow response of the LCD 300, the human eye cannot perceive the disturbance. Thus, even when the LCD 300 starts being driven at almost the same time that the display voltage generating circuit 2-1 starts operating, it is possible to substantially eliminate disturbance of the displayed image that occurs immediately after display is started on the LCD 300.

In this and the following embodiments, by switching on and off the supply of electric power to the display voltage generating circuit 2-1 described above, or to the display voltage generating circuit 2-2 described later, the operation thereof is started or stopped. Alternatively, the outputs of the operational amplifiers OP1, OP2, OP3, OP4, and OP5 may be turned on and off so that, by turning these on and off, the output operation of the display voltage generating circuit 2-1 is started and stopped, with electric power kept supplied to the individual operational amplifiers. By providing a switch circuit for each operational amplifier so that the switch circuit turns a bias resistor off to turn the output of the corresponding operational amplifier, it is possible to reduce electric power consumption.

Figure 4:
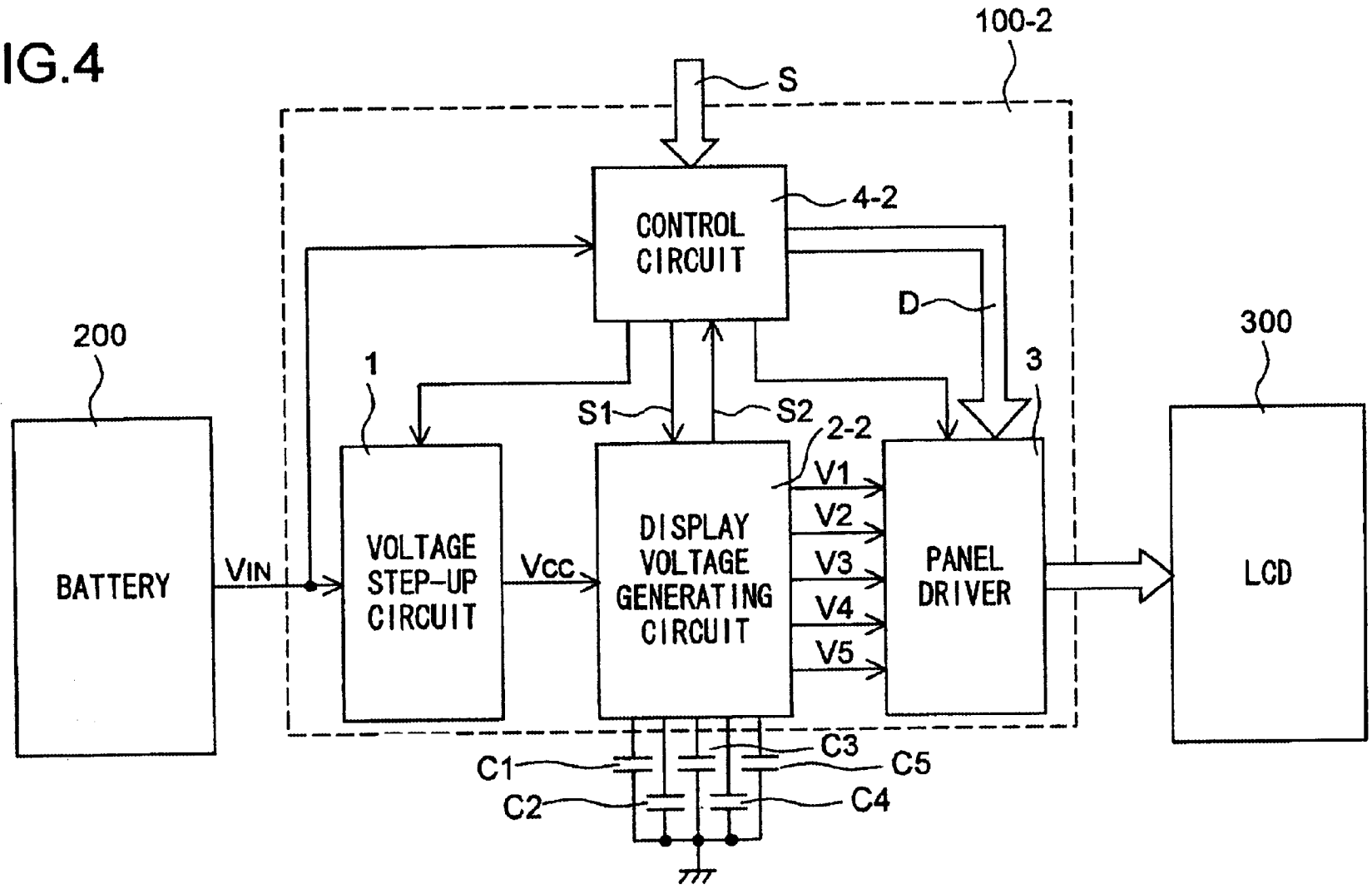
FIG. 4 is a block diagram of the LCD driver device of a second embodiment of the invention.

FIG. 4 shows a block diagram of the LCD driver device of a second embodiment of the invention. Here, such blocks and elements as are found also in the conventional LCD driver deice shown in FIG. 2 are identified with the same reference numerals and symbols, and their explanations will be omitted. The LCD driver device 100-2 of the second embodiment is composed of a voltage step-up circuit 1, a display voltage generating circuit 2-2, a panel driver 3, and a control circuit 4-2, and these are formed on a common semiconductor substrate to form a single-chip IC. From a voltage $V_{CC}$ output from the voltage step-up circuit 1, the display voltage generating circuit 2-2 produces, for example, five display voltages V1, V2, V3, V4, and V5.

Figure 5:
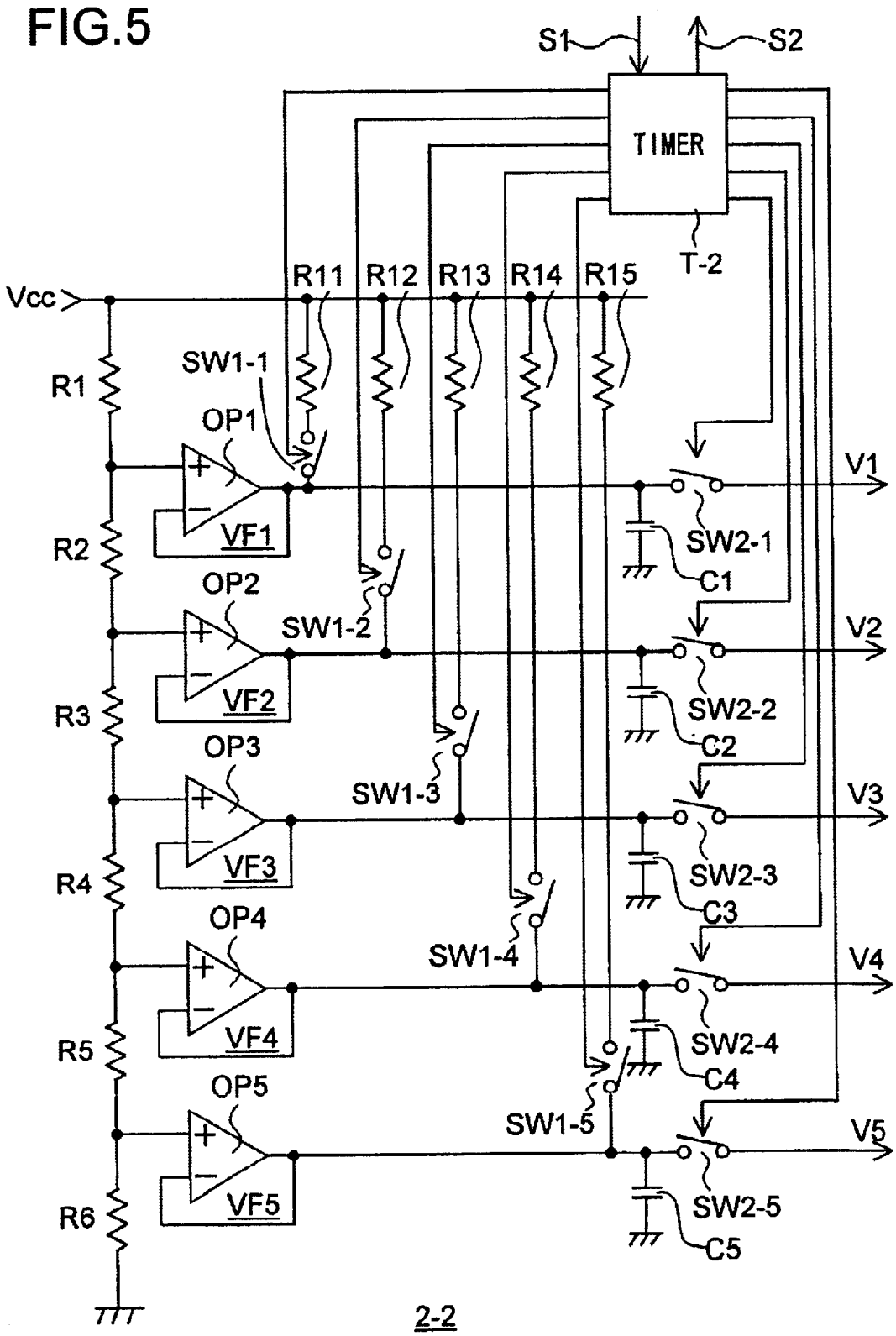
FIG. 5 is a diagram showing the configuration of the display voltage generating circuit provided in the LCD driver device of the second embodiment of the invention.

FIG. 5 shows the circuit configuration of the display voltage generating circuit 2-2. Here, such elements as are found also in the display voltage generating circuit 2-1 of the first embodiment described above are identified with the same reference numerals and symbols, and their explanations will be omitted. The display voltages V1, V2, V3, V4, and V5 are output through a second group of switches SW2-1, SW2-2, SW2-3, SW2-4, and SW2-5.

A timer T-2, on receiving a command requesting it to start counting in the form of a signal S1 from the control circuit 4-2, turns the first group of switches SW1-1, SW1-2, SW1-3, SW1-4, and SW1-5 on, and simultaneously starts counting. Thereafter, when the count value becomes equal to a value corresponding to a predetermined period (specifically, the period assumed to be required for the display voltage V5 to reach the prescribed level), the timer T-2 turns the first-group switch SW1-5 off and turns the second-group switch SW2-5 on. Then, when the count value becomes equal to the value corresponding to a predetermined period (specifically, the period assumed to be required for the display voltage V4 to reach the prescribed level), the timer T-2 turns the first-group switch SW1-4 off and turns the second-group switch SW2-4 on. Then, when the count value becomes equal to the value corresponding to a predetermined period (specifically, the period assumed to be required for the display voltage V3 to reach the prescribed level), the timer T-2 turns the first-group switch SW1-3 off and turns the second-group switch SW2-3 on. Then, when the count value becomes equal to the value corresponding to a predetermined period (specifically, the period assumed to be required for the display voltage V2 to reach the prescribed level), the timer T-2 turns the first-group switch SW1-2 off and turns the second-group switch SW2-2 on. Then, when the count value becomes equal to the value corresponding to a predetermined period (specifically, the period assumed to be required for the display voltage V1 to reach the prescribed level), the timer T-2 turns the first-group switch SW1-1 off and turns the second-group switch SW2-1 on. When all of the second group of switches are on, the timer T-2 feeds a signal S2 to the control circuit 4-2 to notify it of the end of counting.

The control circuit 4-2, when a command COM fed thereto requests starting of display on an LCD 300, controls the voltage step-up circuit 1 and the display voltage generating circuit 2 to start their operation, and feeds the signal S1 to the timer T-2 to instruct it to start counting. Moreover, the control circuit 4-2, when notified of the end of counting by the signal S2 from the timer T-2, starts the operation of the panel driver 3, that is, it starts the driving of the LCD 300.

In this configuration, immediately after the display voltage generating circuit 2-2 starts operating, the capacitors C1, C2, C3, C4, and C5 for smoothing the display voltages V1, V2, V3, V4, and V5 receive current also from the supply voltage $V_{CC}$ through the resistors R11, R12, R13, R14, and R15, and are thus charged more quickly than in the conventional configuration. As a result, whereas in the conventional configuration the display voltages V1, V2, V3, V4, and V5 each have a waveform as indicated by a broken line in FIG. 3 in their rising period, in this embodiment they each have a waveform as indicated by a solid line in FIG. 3. That is, the period required for each of the display voltages V1, V2, V3, V4, and V5 to reach the prescribed level is shortened. In addition, while the capacitors C1, C2, C3, C4, and C5 are being charged with the supply voltage $V_{CC}$, the display voltages V1, V2, V3, V4, and V5 are not supplied to the panel driver 3. Thus, only when the display voltages V1, V2, V3, V4, and V5 have reached the prescribed voltages (i.e. at $t_1$ in FIG. 3) is the panel driver 3 ready to drive the LCD 300. In this way, it is possible, while avoiding an undue increase in the period required to start display on the LCD 300, to eliminate disturbance of the displayed image that occurs immediately after display is started on the LCD 300.

Moreover, in the second embodiment, each capacitor is charged with the supply voltage $V_{CC}$ for the period that is assumed to be required for the corresponding display voltage to reach the prescribed level after the display voltage generating circuit 2-2 starts operating. This makes it possible to minimize the required period without ineffective electric power consumption before display is started on the LCD 300.

When display is stopped, all of the second group of switches are turned off when the supply of electric power to the display voltage generating circuit 2-2 is shut off. At the start of operation, the second-group switches are turned on one by one as the corresponding first-group switches are turned off one after another. Alternatively, all of the second group of switches may be turned on simultaneously when all of the first group of switches have been turned off. This helps simplify the configuration of the timer T-2. Since the display voltages are not supplied to the panel driver 3 until all of them reach the prescribed levels, even when the panel driver 3 starts being driven at the same time that the display voltage generating circuit 2-2 starts its output operation, the displayed image is not disturbed.

Moreover, in the second embodiment, between the corresponding first-group and second-group switches, a first-group switch is turned from on to off with substantially the same timing as the corresponding second-group switch is turned from off to on. Alternatively, a second-group switch may be turned on a predetermined period after the corresponding first-group switch is turned off. This ensures that, even when the capacitances of the capacitors vary to a certain degree on the higher side, the LCD starts being driven after the display voltages have reached the prescribed levels. Thus, it is possible to eliminate disturbance of the displayed image that occurs immediately after display is started on the LCD.

In the LCD driver devices of the embodiments described above, the capacitors for smoothing the display voltages are connected externally. However, it is also possible to use parasitic capacitance alone, or to connect only part of the capacitors externally. The voltage step-up circuit may be omitted, in which case the display voltage generating circuit may produce the display voltages directly from the voltage supplied from the battery. Display data need not be fed in from outside, in which case display may be achieve by using data stored in a ROM within the control circuit. The display voltages may be produced in any other manner than specifically described above. The LCD may be of a segment type.

INDUSTRIAL APPLICABILITY

According to the present invention, it is possible to shorten the period required after the display voltage generating circuit starts operating until the display voltages reach the prescribed levels. Thus, even when the LCD starts being driven at almost the same time that the display voltage generating circuit starts operating, the driving voltages fed to the LCD remain unstable only for a shorter period. In this way, it is possible to reduce disturbance of the displayed image that occurs immediately after display is started on the LCD.

Not only is the period shortened that is required after the display voltage generating circuit starts operating until the display voltages reach the prescribed levels, but also the LCD can be driven after the display voltages have reached the prescribed levels. Thus, it is possible, while avoiding an undue increase in the period required to start display on the LCD, to eliminate disturbance of the displayed image that occurs immediately after display is started on the LCD.

Moreover, it is possible to minimize the required period without increasing ineffective electric power consumption due to current that flows through the resistors after the display voltage generating circuit starts operating and even after the display voltages have reached the prescribed voltages.

What is claimed is:

1. An LCD driver device comprising a display voltage generating circuit for generating a display voltage as a bias voltage needed to effect display on an LCD, a capacitive element for smoothing the display voltage, and a panel driver for driving the LCD by using the display voltage, characterized by further comprising a charge circuit for charging the capacitive element with a supply voltage, a charge control switch circuit for switching the charge circuit between operating and non-operating states, and a charge control circuit for controlling the charge control switch circuit in such a way that the charge circuit is kept in the operating state for a predetermined period after the display voltage generating circuit starts operating.

2. An LCD driver device as claimed in claim 1, further comprising a display voltage supply control switch circuit for switching supply of the display voltage to the panel driver on and off, and a display voltage supply control circuit for controlling the display voltage supply control switch circuit in such a way that the display voltage is not supplied to the panel driver at least for a period needed for the display voltage to reach a prescribed voltage after the display voltage generating circuit starts operating.

3. An LCD driver device as claimed in claim 1, wherein the predetermined period for which the charge circuit is kept in the operating state equals a period required for the display voltage to reach a prescribed voltage.

4. An LCD driver device, comprising:

a display voltage generating circuit for generating a plurality of display voltages as a plurality of bias voltages needed to effect display on an LCD, a plurality of capacitive elements, connected individually to outputs of the display voltage generating circuit, for smoothing the display voltages;

a plurality of charge circuits for charging the capacitive elements individually with a supply voltage;

a plurality of charge control switches for individually or collectively switching the charge circuits between operating and non-operating states;

a charge control circuit for controlling the charge control switch circuits in such a way that the charge circuits are kept in the operating state for a predetermined period after the display voltage generating circuit starts operating; and a panel driver for driving the LCD with the bias voltages smoothed by the capacitive elements.

5. An LCD driver device as claimed in claim 4, wherein the charge circuits each have a resistor of which one end is connected to the supply voltage and of which another end is connected through the corresponding charge control switch to the corresponding capacitive element, and the charge control circuit, on receiving a command signal requesting starting of counting, turns the charge control switches on and simultaneously starts counting until, when the display voltages smoothed by the capacitive elements reach prescribed voltages, the charge control circuit turns the charge control switches off.

6. An LCD driver circuit comprising a voltage step-up circuit for stepping up a voltage supplied from a battery, a display voltage generating circuit for generating a plurality of display voltages by using as a supply voltage an output voltage from the voltage step-up circuit, a panel driver for driving an LCD according to display data by using the plurality of display voltages, and a control circuit for controlling the voltage step-up circuit, the display voltage generating circuit, and the panel driver, wherein the display voltage generating circuit comprises:

a plurality of capacitive elements for smoothing the plurality of display voltages individually;

a plurality of charge circuits for charging the plurality of capacitive elements with the supply voltage;

a plurality of charge control switches for switching the plurality of charge circuits between operating and non-operating states; and a charge control circuit for controlling the plurality of charge control switches in such a way that the charge circuits are kept in the operating state for a predetermined period after the display voltage generating circuit starts operating.

7. An LCD driver device as claimed in claim 6, wherein the charge circuits each have a resistor of which one end is connected to the supply voltage and of which another end is connected through the corresponding charge control switch to the corresponding capacitive element, and the charge control circuit, on receiving a command signal requesting starting of counting, turns the charge control switches on and simultaneously starts counting until, when the display voltages smoothed by the capacitive elements reach prescribed voltages, the charge control circuit turns the charge control switches off.

8. An LCD driver device as claimed in claim 6, further comprising a plurality of display voltage supply control switches for switching supply of output voltages of the capacitive elements to the panel driver on and off, and a display voltage supply control circuit for controlling the display voltage supply control switches, wherein, when all the charge control switches are turned off, the display voltage supply control circuit turns all the display voltage supply control switches on.

9. An LCD driver device as claimed in one of claims 1 to 8, wherein the resistor or resistors are each given a higher resistance the lower the output voltage expected to be output from the corresponding capacitive element, and all the switches are controlled with identical timing.

* * * * *